US005699560A

United States Patent [19]

Greenberg

[11] Patent Number: 5,699,560

[45] Date of Patent: Dec. 23, 1997

[54] BACKPACK WITH INTEGRAL GARMENT

[76] Inventor: Peter Greenberg, 825 Cemetary La., Aspen, Colo. 81611

[21] Appl. No.: 694,634

[22] Filed: Aug. 7, 1996

[51] Int. Cl.[6] ..... A41D 1/02; A41D 3/02; A41D 15/04; A45F 4/00

[52] U.S. Cl. ..... 2/94; 2/93; 2/108; 2/85

[58] Field of Search ..... 2/94, 93, 108, 2/85; 224/153, 575, 577

[56] References Cited

U.S. PATENT DOCUMENTS

| | | | |
|---|---|---|---|
| D. 316,172 | 4/1991 | Hanson | D2/181 |
| 2,165,348 | 7/1939 | Daiber | 2/94 |
| 2,248,455 | 7/1941 | Freund | 2/94 |
| 2,292,347 | 8/1942 | Bailey . | |
| 2,507,322 | 5/1950 | Smith | 2/94 X |
| 4,307,470 | 12/1981 | Ezell | 2/108 |
| 4,389,735 | 6/1983 | McLaughlin . | |
| 4,404,689 | 9/1983 | DeWan | 2/94 X |
| 4,475,251 | 10/1984 | Hopkins | 2/94 |
| 4,491,258 | 1/1985 | Jones | 224/153 |
| 4,502,155 | 3/1985 | Hoi | 2/94 X |
| 4,563,777 | 1/1986 | Park . | |
| 4,669,127 | 6/1987 | Swanson | 2/94 X |
| 4,949,401 | 8/1990 | Kimsey, Jr. | 2/102 |
| 5,123,117 | 6/1992 | Prendergast | 2/108 |
| 5,165,111 | 11/1992 | Lieberman | 2/94 |
| 5,407,112 | 4/1995 | Christodoulou et al. | 224/153 |

FOREIGN PATENT DOCUMENTS

| | | | |
|---|---|---|---|
| 5300808 | 11/1993 | Japan | 224/153 |
| 49696 | 9/1910 | Switzerland | 224/153 |
| 85003 | 8/1919 | Switzerland | 224/153 |

*Primary Examiner*—C. D. Crowder
*Assistant Examiner*—Shirra L. Jenkins
*Attorney, Agent, or Firm*—Allen H. Erickson

[57] ABSTRACT

An integral backpack/upper body garment comprises a garment to which a split backpack is attached or attachable to the back panel of an upper body garment. A front backpack assembly including front assembly with shoulder straps is attached/attachable to the front face of the back panel, and a rear backpack assembly including storage compartments is attached/attachable to the rear face of the back panel. A circumferential garment compartment has two walls, one attached to the front assembly and one attached to the rear assembly. The jacket may be rolled up or folded into the garment compartment and the two walls joined by a closure to protectively enclose the garment therein when it is not worn. The backpack may be worn with or without the integral jacket, and the jacket may be worn with or without the backpack.

26 Claims, 7 Drawing Sheets

BACKPACK WITH INTEGRAL GARMENT

BACKGROUND OF THE INVENTION

This invention relates generally to backpacks useful for carrying supplies of all kinds. More particularly, this invention pertains to backpacks adapted to carry an upper body garment such as a jacket.

Backpacks are manufactured in a variety of sizes and styles, with a wide range of different features to accommodate the needs and desires of many people. Smaller backpacks known as daypacks are typically made without internal or external frames, and serve as book carriers for students, to hold one-day supplies for hikers, and the like. Often, the need for a jacket or sweatshirt presents itself, e.g. when precipitation or falling temperatures are encountered. Typically, a jacket or other protective garment is placed in the backpack, if there is sufficient room, or is carried by hand.

It is known to attach a backpack to an upper body garment, for example, see U.S. Pat. No. 4,949,401 of Kimsey, Jr. However, confined storage of the garment integrally with the backpack without reducing the backpack storage capacity is not known in the prior art.

BRIEF SUMMARY OF THE INVENTION

The primary object of this invention is to provide a combination backpack/upper body garment whereby the jacket is available on demand and otherwise enclosed in the backpack.

A further object of the invention is to provide a backpack with an integral jacket whereby the jacket may be removed and placed on the packer's body without removing the backpack, and without restricting access to the backpack compartments.

Another object of the invention is to manufacture an integral backpack/garment using an existing commercially available backpack and a commercially available upper body garment.

A further object of the invention is to provide an integral backpack/garment from an existing backpack, without sacrificing any backpack space for storage of the garment.

Another object of the invention is to provide a backpack with an integral, yet removable upper body garment to enable independent and separate usage of the backpack and garment.

A backpack is provided which has a back facing portion including at least one compartment, and a front facing portion including shoulder straps. The back facing portion is attached, either reversibly or permanently, to the rear face of the back panel of an upper body garment. The front facing portion may be reversibly or permanently attached to the front face of the back panel of the upper body garment. A garment holding compartment is formed of two members, one adjacent the garment front face and the other adjacent the garment rear face. Each half of the garment holding compartment is substantially circumferential about the backpack. The two members of the compartment may be joined by a closing device such as a zipper, Velcro adhesive pads, snaps, or other devices to enclose a rolled-up garment therein.

These and other objects and advantages of the invention will be readily understood by reading the following description in conjunction with the accompanying figures of the drawings wherein like reference numerals have been applied to designate like elements throughout the several views.

DESCRIPTION OF THE PREFERRED EMBODIMENTS

Figure 1:
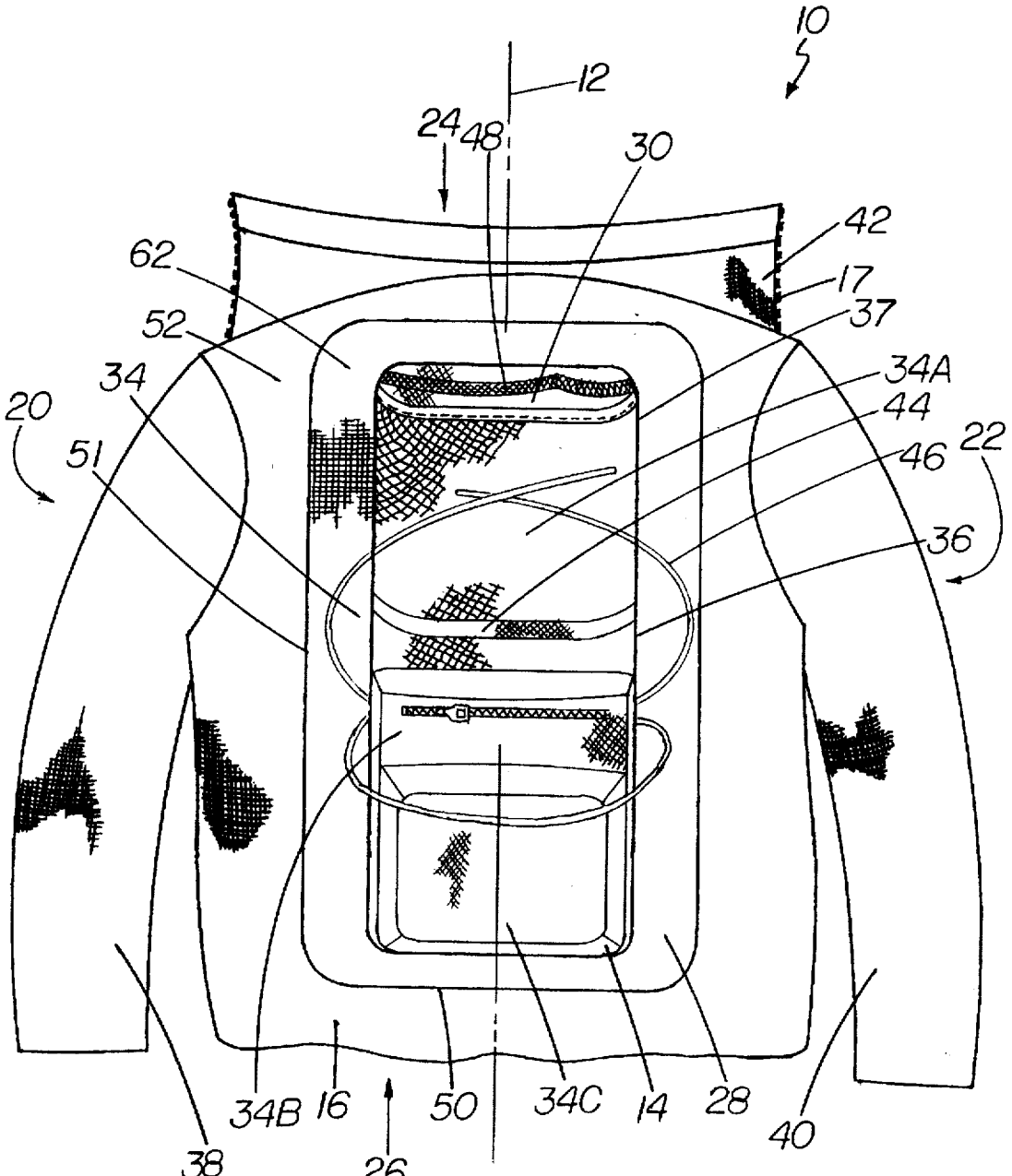
FIG. 1 is a rear view of an integral backpack/upper body garment of the invention with an unfurled garment.

For the sake of best illustrating the invention in the drawings, the components of the entire integral backpack/upper body garment 10, except where specifically stated otherwise, are depicted as essentially arranged in mirror symmetry about a vertical, median, longitudinal plane 12. Consequently, a description of the parts in one side serves equally to identify the parts in the opposite side. This in no way is intended to limit the invention to a symmetric configuration, however.

In FIG. 1, an integral backpack/upper body garment 10 is shown as including a rear backpack assembly 14 and an exemplary upper body garment 16, e.g. a jacket with zipper closure 17. The garment 16 may be rolled up on the left side 20 including left sleeve 38, right side 22 including right sleeve 40, top 24 including zippered collar 42, and bottom 26, all inwardly rolled toward the center of the backpack assembly 14. The back panel 52 of garment 16 extends into and through a substantially circumferential garment compartment 28 and is joined to, and as best exemplified, sandwiched between a backpack rear panel 30 and front panel 32, the latter visible in FIG. 2. When the garment 16 is rolled up from all directions into the garment compartment 28, closure of the compartment confines the garment within the annulate compartment. The inner periphery 37 of the garment compartment 28 is generally abutting the outer periphery 36 of the rear backpack assembly 14, and generally conforms to the outline of rear backpack assembly, even if not rectangular as shown. A garment compartment closure 50 is shown in FIG. 3 encircling the outer periphery 51 of the garment compartment 28, and may comprise a zipper, snaps, Velcro hook-and-loop fastener pads and/or other type of closure. The garment compartment 28 may be opened, even without removal from a person's shoulders, and the garment unfurled for immediate wear.

In FIG. 1 is shown an exemplary configuration of a backpack rear assembly 14 with at least one storage compartment 34, herein illustrated as a plurality of rear storage compartments denoted by indicia 34A, 34B, and 34C. The rear backpack assembly 14 may also include elastic straps 44, lash cords 46, bottle holder 48, and/or other backpack apparatus useful to a backpack user, such as bottle holsters, water tank, waist belt, key holder, ice axe loop, and the like.

The integral backpack/upper body garment 10 may be formed with permanent attachment such as sewing along or on either side of outer periphery 36 and/or inner periphery 68. Alternatively, in another version, the rear backpack assembly 14 and/or front backpack assembly 18 may be removable from the garment 16 for separate, independent use. The permanently attached version will be described first.

Figure 2:
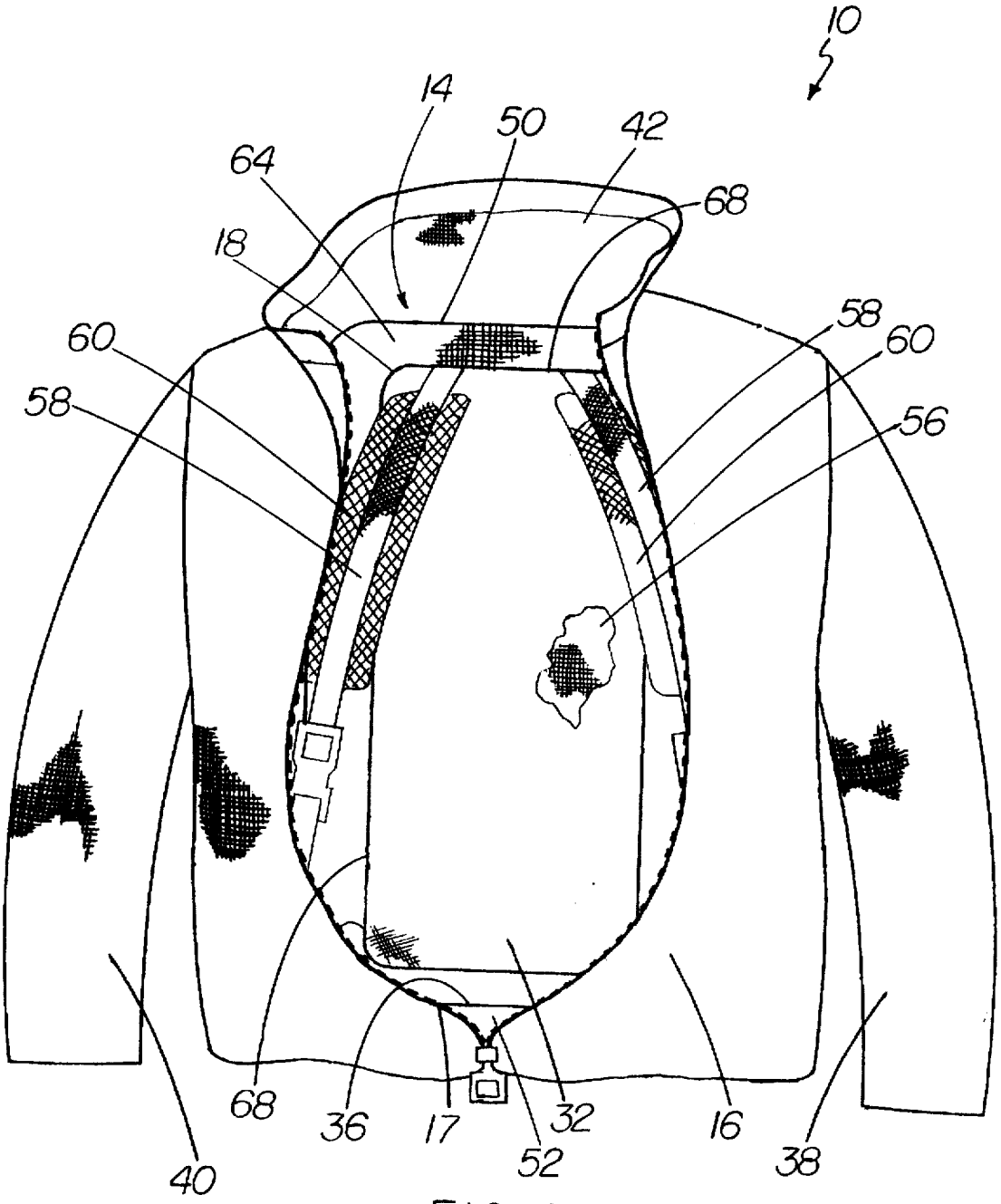
FIG. 2 is a front view of an integral backpack/upper body garment of the invention with an unfurled garment.
Figure 3:
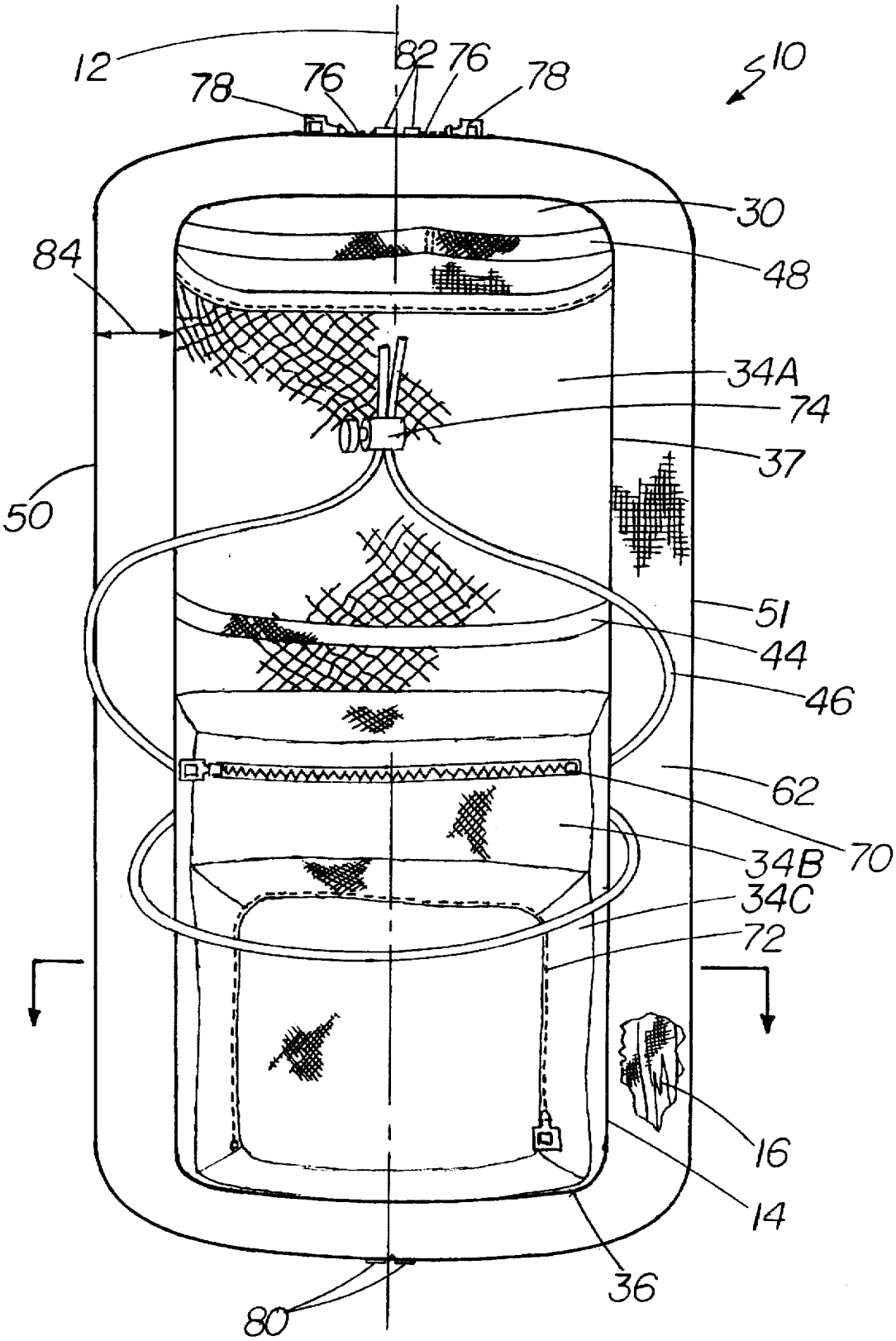
FIG. 3 is a rear view of an integral backpack/upper body garment of the invention with enclosed garment.

As illustrated in FIG. 2, the front backpack assembly 18 is mounted on the front face 56 of the garment back panel 52, and includes shoulder straps 58 with pads 60, by which the weight of the rear backpack assembly 14 and its contents may be supported on the shoulders of a wearer. The front backpack assembly 18 also includes a front garment compartment wall 64 which may be joined by a closure 50, previously described, to rear garment compartment wall 62 when the garment 16 is rolled up into the space between the two walls 62 and 64. A front panel 32, typically of fabric, is shown as overcovering the front face 56 and joined to the inner periphery 68 of the front garment compartment wall 64. Typically, front panel 32 generally conforms to the size and shape of rear panel 30, the two overcovering opposite sides of the same garment area. Closure 50 may be a zipper, mating Velcro hook-and-loop fastener pads, snaps, or other type of closure, but it is preferred to use a zipper or elongate strips of matching Velcro hook-and-loop fastener material.

Although the invention is shown with a front panel 32 overcovering the front face 56 of the garment back 52, the front panel 32 may be omitted in some situations.

Figure 4:
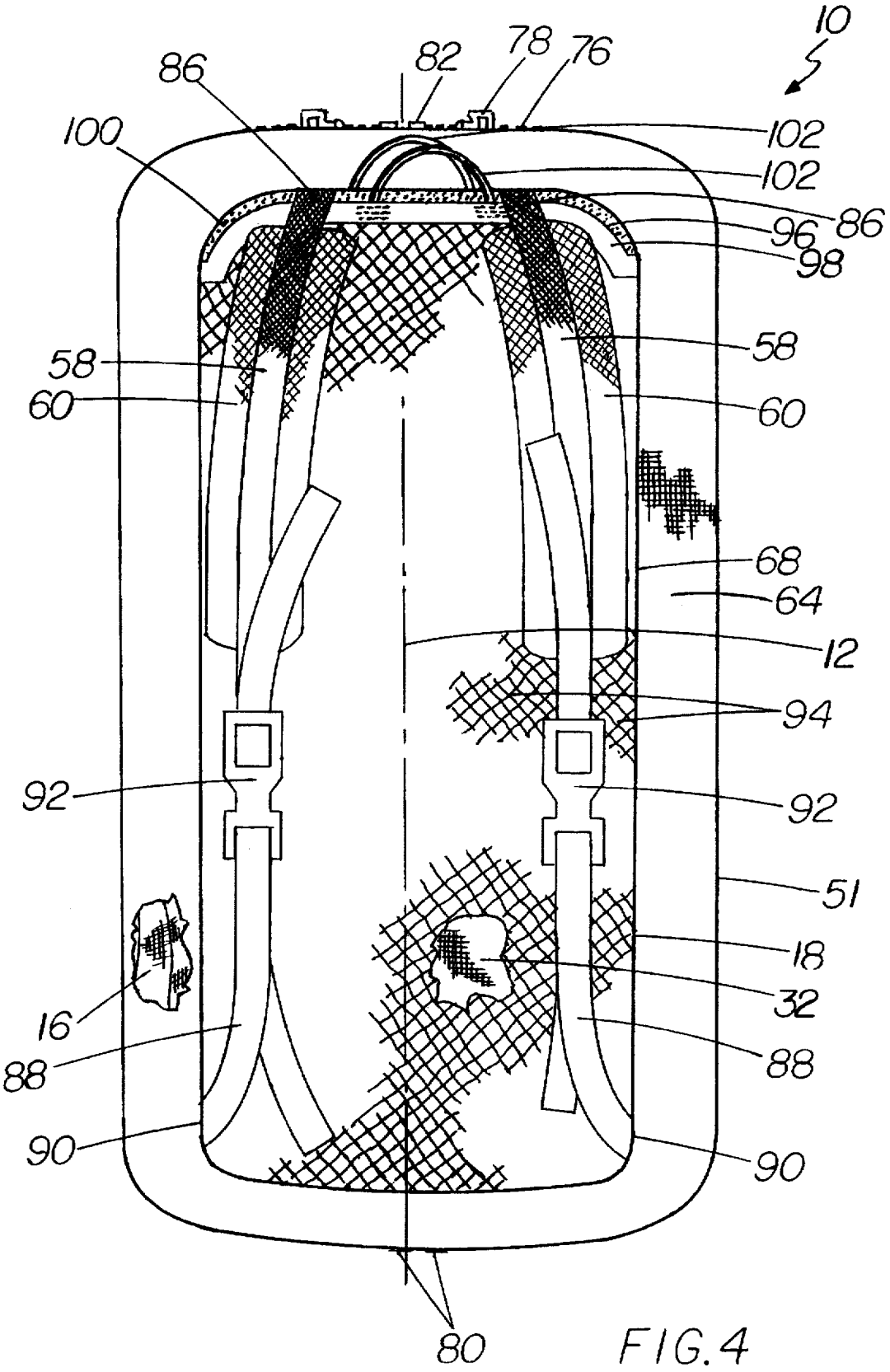
FIG. 4 is a front view of an integral backpack/upper body garment of the invention with enclosed garment.

FIGS. 3 and 4 illustrate the invention with the garment 16 rolled up or folded within the circumferential garment compartment 28. The rear backpack assembly of FIG. 3 is shown with a mesh compartment 34A, a second compartment 34B with zipper 70, and a third compartment 34C with zipper 72. Lash cords 46 are joined with a clinch 74. The circumferential garment compartment 28 is formed from a front wall 64 positioned forward of the garment back panel 52 (see FIGS. 1 and 2), and a rear wall 62 positioned rearward of the garment back panel; the two walls 62, 64 are in the preferred embodiment substantially mirror images of each other, and are joinable with a closure 50 along their outer periphery 51. The inner periphery 68 of the rear wall 62 of the garment compartment 28 is joined to the rear backpack assembly 14.

A closure 50 comprising two zippers 76 are positioned about the outer periphery 51 of the garment compartment 28, one on each side of the backpack assembly 14. Each zipper 76 with pull 78 is shown as operative between an open stop 80 at the bottom of the backpack and a closed stop 82 at the top of the backpack. Alternatively, Velcro hook-and-loop fastener material adhesion strips, snaps, or other closure devices may be used in place of the zippers 76.

A garment 16 is shown rolled up or folded within the circumferential garment compartment 28 abutting the backpack rear assembly 14 at its periphery line 36. The width 84 of the garment compartment 28 need only be enough to enable the rolled up garment 16 to fit therein and the closure 50 closed. Typically, the lateral vertical portions will be wider than the upper and lower portions of the garment compartment 28 because of the larger garment portions which must fit therein.

FIG. 4 shows the front backpack assembly 18 and surrounding garment compartment front wall 64. The front assembly 18 includes a pair of shoulder straps 58 with attached shoulder pads 60. The upper ends 86 of the shoulder straps 58 are attached to the upper portion of the front assembly 18, and the lower ends 88 are attached on lower edge portions 90 of the front assembly. The shoulder straps 58 are shown with buckles 92. The front assembly 18 is also shown with a full length net container 94. The upper closure 100 is shown with opposing Velcro hook-and-loop fastener material adhering surfaces 96, 98, and handles 102 for opening the closure. Alternatively, a zipper, snaps or other closure device may be used in place of the Velcro hook-and-loop fastener material surfaces 96, 98.

Like the rear wall 62, the front wall 64 of the circumferential garment compartment 28 has its inner periphery 68 joined to the backpack assembly. Its outer periphery 51 has a pair of zippers 76 which match the zippers 76 on the rear wall 62. When the zippers 76, 76 of both walls 62, 64 are joined and zipped to a closed position, the rolled up garment 16 is confined within the circumferential garment compartment 28 where it is protected from becoming soiled or wet.

Figure 5:
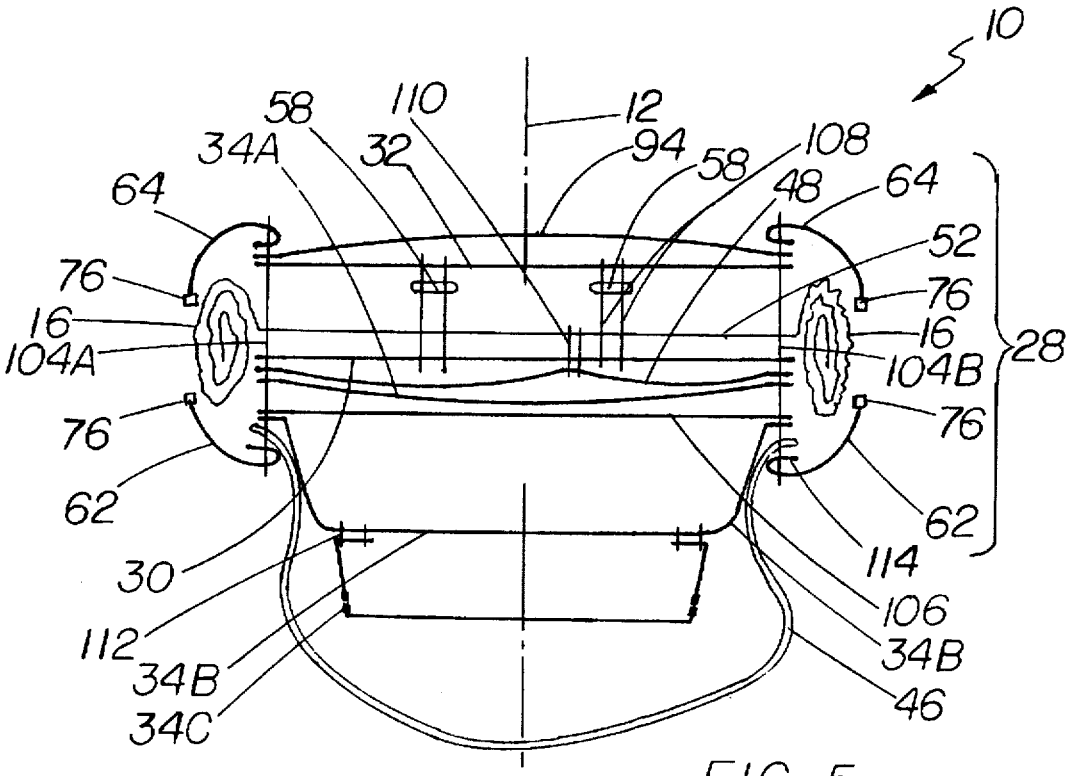
FIG. 5 is a horizontal cross-sectional view of an integral backpack/upper body garment in accordance with the invention, as taken along line 5—5 of FIG. 3 and exploded to better show the separate elements.

Turning now to FIG. 5, the construction of an exemplary one-piece, i.e. permanently joined integral backpack/garment 10 is shown in exploded cross-section. The major portions including garment compartment walls 62, 64, net compartment 94, front panel 32, garment back panel 52, rear panel 30, elasticized tape 48, rear net compartment 34A, second compartment back 106 of compartment 34B, compartment 34B, and lash cord 46 are shown as being joined together by major stitch lines 104A, 104B. It should be noted that stitch lines 104A and 104B are in actuality the same line which is circumferential about backpack/garment 10. The walls 62, 64 are shown as including a fold 114 to increase the strength along the stitch lines 104A, 104B.

Secondary stitch lines include stitch lines 108 for joining the upper ends of the shoulder straps 58 to the front and rear panels 32, 30. Secondary stitch lines 110 attach an intermediate portion of elasticized tape 48 to the rear panel 30. Secondary stitch lines 112 attach a third compartment 34C to the second compartment 34B.

Figure 6:
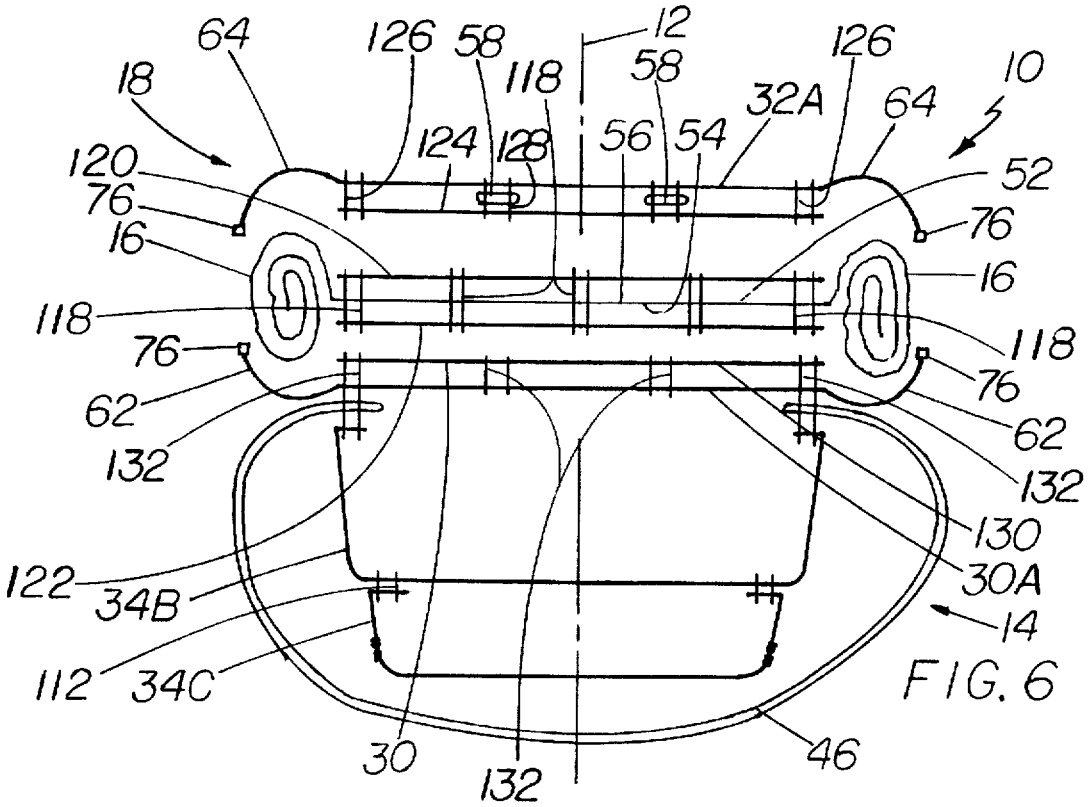
FIG. 6 is a horizontal cross-sectional view of another embodiment of an integral backpack/upper body garment in accordance with the invention, as taken along line 5—5 of FIG. 3 and exploded to better show the separate elements.

The construction of an exemplary 3-part detachable backpack/garment 10 is illustrated in FIG. 6. In this embodiment, either or both of the front backpack assembly 18 and rear backpack assembly 14 may be removed from the garment 16. The front backpack assembly 18 and rear backpack assembly 14 may be joined together for use independent of the garment 16, and the garment may be separately worn.

As shown in FIG. 6, a front panel 32A is an integral central portion of front compartment wall 64 and they comprise a single member. Likewise, rear panel 30A is an integral central portion of rear compartment wall 62 and they comprise a single member.

Velcro adhering hook-and-loop fastener material pads 120, 122 are joined to the front face 56 and rear face 54, respectively, of garment back panel 52 by sewing along stitch lines 118. Preferably, pad 120 has a loop surface and pad 122 has a hook surface. Thus, the garment 16 with attached Velcro hook-and-loop fastener material pads 120, 122 may be separately worn or combined with the front backpack assembly 18 and/or rear backpack assembly 14 to form a complete integral backpack/garment 10 with integral garment compartment 28.

A Velcro hook-and-loop fastener material pad 124 is attached to the rear face of the front panel 32A by sewing along stitch lines 126. The upper ends of shoulder straps 58 are attached to the combined pad 124 and panel 32A along stitch lines 128. The Velcro hook-and-loop fastener material pad 124 is configured to reversibly engage Velcro hook-and-loop fastener material pad 120 and be adhered thereto.

A Velcro hook-and-loop fastener material pad 130 is shown attached to the front face of the rear panel 30A along stitch lines 132, and is configured to reversibly engage Velcro hook-and-loop fastener material pad 122 and be adhered thereto. Backpack components represented by compartments 34B and 34C and cord 46 are attached to the rear panel 30A along the same or other stitchlines including stitchlines 112. As joined by sewing, the rear backpack assembly 14 includes the rear wall 62 of the garment compartment 28.

Figure 7:
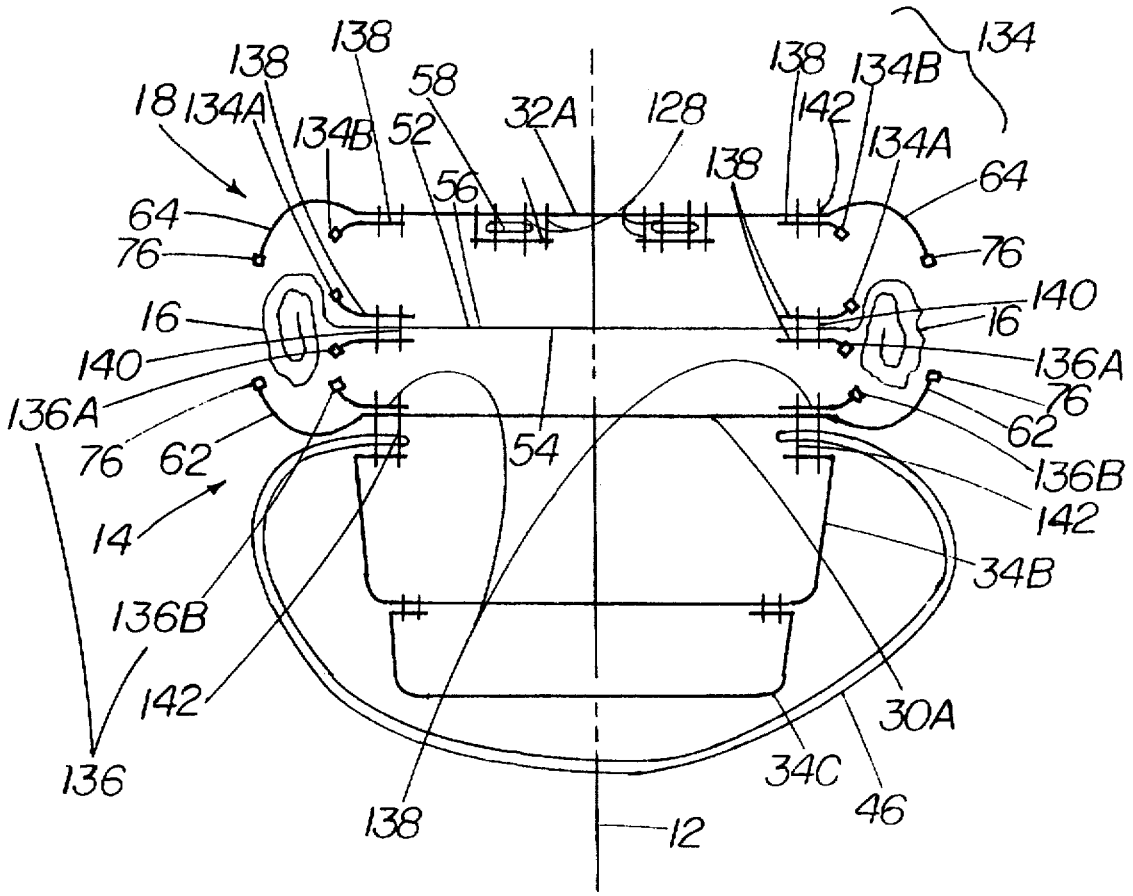
FIG. 7 is a horizontal cross-sectional view of a further embodiment of an integral backpack/upper body garment in accordance with the invention, as taken along line 5—5 of FIG. 3 and exploded to better show the separate elements.

A detachable 3-part backpack/garment 10 may also be formed whereby the front assembly 18 and/or rear assembly 14 are attachable to the garment 16 with zippers, snaps, or other connecting devices. As shown in FIG. 7, where both assemblies 14, 18 are to be removable from the garment 16, mating zippers are used on each side of the garment back panel 52. Each zipper is shown with an attachment strip 138, and further reinforcement strips, not shown, may be added if desired. Zipper 134 has two halves 134A and 134B. Second half-zipper 134A and first half-zipper 136A are attached to the front face 56 and rear face 54, respectively, of the garment back panel 52 along stitch lines 140 to project into the circumferential garment compartment 28 formed by walls 62 and 64. Likewise, fourth half-zipper 134B and third half-zipper 136B are attached to the front panel 32A and rear panel 30A, respectively, along stitch lines 142 to face half-zippers 134A and 136B, respectively, within garment compartment 28. Half-zipper 134A may be joined to half-zipper 134B to attach the front backpack assembly 18 to the garment 16. Likewise, half-zipper 136A may be joined to half-zipper 136B to attach the rear backpack assembly 14 to the garment 16. Both zippers 134 and 136 are within the front wall 64 and rear wall 62 of the circumferential garment compartment 28, being generally not in view.

If desired, each of zippers 134, 136 may be replaced by a pair of shorter zippers, typically one on each side of the backpack/garment 10.

Figure 8:
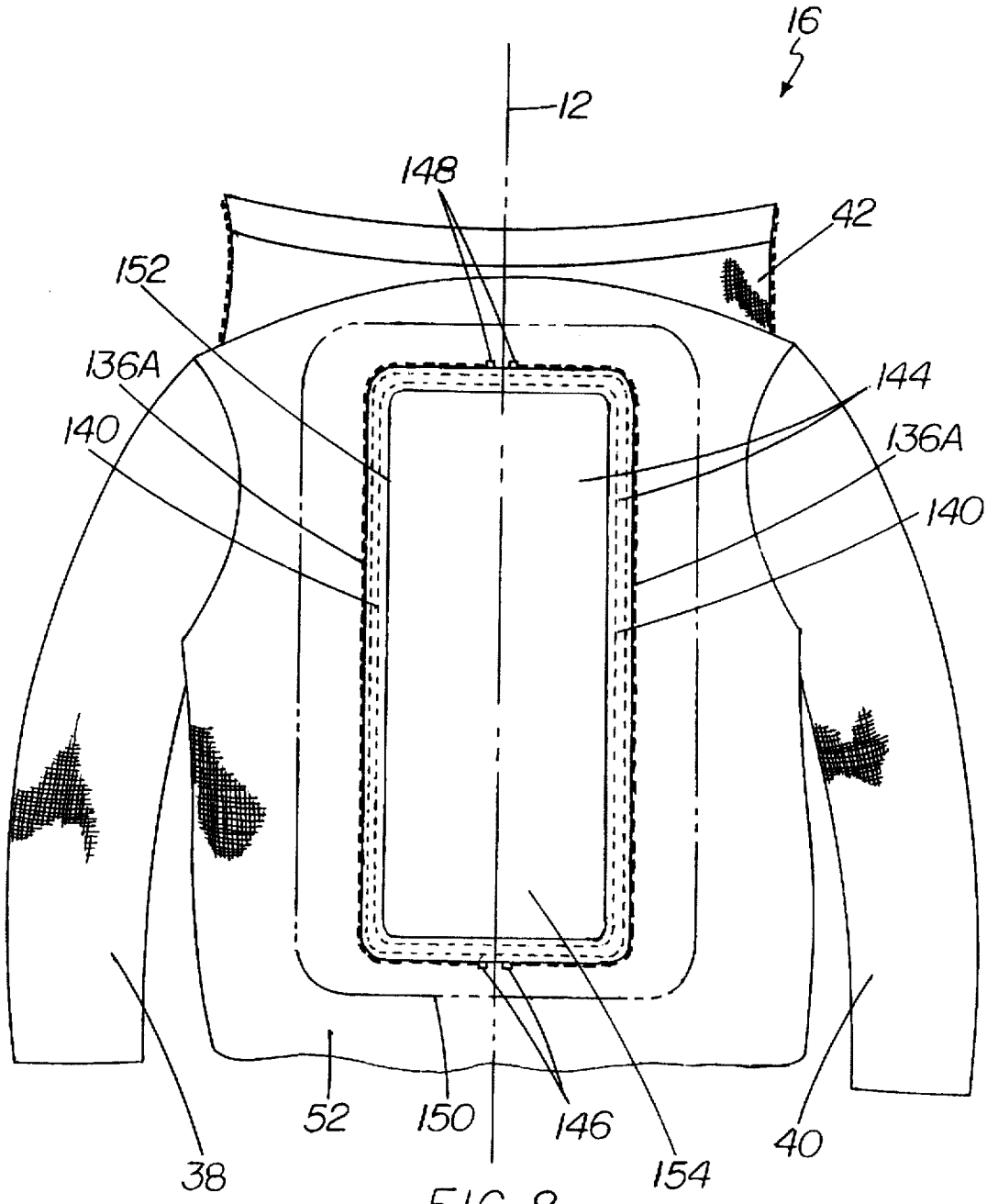
FIG. 8 is a rear view of the rear face of an upper body garment of the invention from which a backpack of the invention has been reversibly removed.

FIG. 8 is a rear view of the garment 16 depicted in FIG. 7, showing two half-zippers 136A, 136A attached by sewing along stitch lines 140 to the back panel 52 of the garment. The two half-zippers generally circumscribe the "footprint" 144 of the rear backpack assembly 18, and each half-zipper is mounted between an open stop 146 and a closed stop 148.

The front face 56 (not visible) of the garment's back panel 52, will have a similar appearance, including a pair of half-zippers 134A mounted thereon.

Ghost line 150 traces the outline of the circumferential garment compartment 28 when the rear backpack assembly 14 is mounted on the garment 16.

The portion 154 of the rear face 54 of the garment back panel 52 which lies within the circuit 152 of half-zippers 136A may be visually enhanced with artwork or writing, as desired.

The materials from which the backpack panels are made are those which have been found useful in the art. The fabrics may be formed of nylon or polyester, or blends thereof, and may be coated with PVC or polyurethane, for example, to provide water resistance. Leather or leather-like materials may also be used. This invention is not limited to any such particular materials, however.

It is apparent that various modifications may be made to the constructions shown in the figures, by which storage compartments 34 may be added or subtracted, additional stitch lines may be added to increase the strength, panel size may be varied, reinforcement strips or panels added, etc. Such changes may not be illustrated in the drawings, but fall within the knowledge of the art.

It is emphasized that the particular backpack configuration shown in the drawings is merely illustrative of the major principle of the invention, i.e. a split backpack attached or attachable to the front and rear surfaces of the back panel of an intermediary upper body garment in a "sandwich" arrangement. Almost any combination of backpack design and upper body garment 16 may be used, provided the backpack dimensions are adaptable to the garment size, and the circumferential garment compartment 28 is proportioned to retain the rolled up or folded garment.

It should be noted that different garments 16 and various configurations of backpack may be used in varied combinations, to achieve the desired backpack capacity, garment type, and size. Thus, garment 16 may be a jacket, vest, sweatshirt, T-shirt, sportshirt, jean-jacket, jean-shirt or other type of upper body garment having an open or openable front. A plurality of garments of differing styles and sizes, and a plurality of front backpack assemblies and rear backpack assemblies having differing sizes and configurations may be interchangeably joined for custom application.

The invention is most useful for outdoor trips of shorter duration, i.e. up to several days. When rented by sporting equipment rental services, interchangeability enables customized adaptation to a client's size and wishes, anticipated weather, etc. Furthermore, an upper garment will always be provided for the substantial numbers of hikers, bikers and others who may underestimate the need for clothing in inclement weather.

It is anticipated that various changes and modifications may be made in the construction, arrangement, operation and method of construction of the backpack/integral upper body garment disclosed herein without departing from the spirit and scope of the invention as defined in the following claims.

What is claimed is:

1. An intregral backpack/upper body garment, comprising:

an upper body garment with a back panel having front and rear faces;

a rear backpack assembly comprising:

a rear panel configured to be attached to said rear face and generally conformed to the rear dimensions of a backpack;

at least one storage compartment attached to said rear panel;

a first garment compartment wall generally circumferential about said rear panel and attached to said rear panel, said first garment compartment wall having an outer periphery with first closure means;

a front backpack assembly comprising;

a front panel configured to be attached to said front face and generally conformed to said rear panel;

a pair of shoulder straps having upper ends and lower ends attached to said front panel;

a second garment compartment wall generally circumferential about said front panel and attached to said front panel, said second garment compartment wall having an outer periphery with second closure means, said first and second, closure means joinable to form a closed garment compartment.

2. The integral backpack/upper body garment of claim 1, wherein said front panel and rear panel are joined with said garment back panel sandwiched therebetween.

3. The integral backpack/upper body garment of claim 2, wherein said front panel and rear panel are joined by sewing about the peripheries thereof.

4. The integral backpack/upper body garment of claim 1, wherein said shoulder straps have upper ends attached to the upper edge of said front panel and lower ends attached to the lower lateral edge of the front panel.

5. The integral backpack/upper body garment of claim 1, wherein said first and second closure means comprise matching half zippers which are joinable to close the circumferential garment compartment.

6. The integral backpack/upper body garment of claim 1, wherein said first and second closure means comprise matching surfaces of adhering hook-and-loop fastener material.

7. The integral backpack/upper body garment of claim 1, wherein said first and second closure means comprise matching snaps.

8. The integral backpack/upper body garment of claim 1, wherein said garment in one configuration thereof has an open front.

9. The integral backpack/upper body garment of claim 1, wherein said rear panel is attached to said rear face by sewing.

10. The integral backpack/upper body garment of claim 1, wherein said front panel is attached to said front face by sewing.

11. The integral backpack/upper body garment of claim 1, further comprising facing mating panels of adhering hook-and-loop fastener material attached to said rear panel and said rear face, whereby said rear panel may be reversibly attached to said garment.

12. The integral backpack/upper body garment of claim 1, further comprising facing mating panels of adhering hook-and-loop fastener material attached to said front panel and said front face, whereby said front panel may be reversibly attached to said garment.

13. The integral backpack/upper body garment of claim 1, wherein said rear panel comprises the integral central portion of said first circumferential garment compartment wall.

14. The integral backpack/upper body garment of claim 1, wherein said front panel comprises the integral central portion of said second circumferential garment compartment wall.

15. An integral three-part backpack/upper body garment, comprising:

an upper body garment with a back panel having front and rear faces;

a first attachment means on said rear face;

a second attachment means on said front face;

a rear backpack assembly comprising:

a rear panel generally conformed to the rear dimensions of a backpack;

a first garment compartment wall positioned circumferentially about said rear panel; and at least one storage compartment attached to said rear panel;

a front backpack assembly comprising:

a front panel conformed to at least a portion of said rear panel;

a second garment compartment wall positioned circumferentially about said front panel; and a pair of shoulder straps having upper ends and lower ends attached to said front panel;

closure means on said first and second garment compartment walls for joining said first and second walls into an annulate garment compartment;

third attachment means for reversibly joining said rear backpack assembly to said rear face; and fourth attachment means for reversibly joining said front backpack assembly to said front face.

16. The integral backpack/upper body garment of claim 15, wherein each of said first, second, third and fourth attachment means is a half zipper, said first half zipper attachable to said third half zipper, and said second half zipper attachable to said fourth half zipper to join said front panel and rear panel to said garment back panel.

17. The integral backpack/upper body garment of claim 16, wherein said attached half zippers underlie said first and second walls.

18. The integral backpack/upper body garment of claim 16, wherein said attached half zippers are confined within said circumferential garment compartment when said closure is closed.

19. The integral backpack/upper body garment of claim 15, wherein said closure means comprises mating pads of adhering hook-and-loop fastener material on said first and second walls.

20. The integral backpack/upper body garment of claim 15, wherein said first and third attachment means comprise facing mating panels of adhering hook-and-loop fastener material.

21. The integral backpack/upper body garment of claim 15, wherein said second and third attachment means comprise facing mating panels of adhering hook-and-loop fastener material.

22. The integral backpack/upper body garment of claim 15, wherein said rear panel and front panel may be detached from said rear and front face, respectively, and joined together to form a unitary backpack without an intermediary upper body garment.

23. The integral backpack/upper body garment of claim 15, wherein a plurality of garments of differing styles and sizes, and a plurality of front backpack assemblies and rear backpack assemblies having differing sizes and configurations may be interchangeably joined for custom applications.

24. An integral backpack/upper body garment, comprising:

a front portion of a backpack, including shoulder straps, attached to the front face of an upper garment back panel, and including a first outwardly extending circumferential wall with an outer periphery;

a rear portion of a backpack, including at least one storage compartment, attached to the rear face of an upper garment back panel, and including a second outwardly extending circumferential wall with an outer periphery; and means for reversibly joining the outer peripheries of said first and second circumferential walls.

25. The integral backpack/upper body garment of claim 24, wherein said reversible joining means comprises one of zippers, mating pads of adhering hook-and-loop fastener material, and mating snaps.

26. A method for removing an open upper body garment from a generally annulate garment holder with a circumferential closure encircling an outer periphery thereof, comprising:

opening said circumferential closure about said outer periphery; and unfurling the garment outwardly from all parts of the holder to form an open garment.

* * * * *